US009098034B2

(12) United States Patent
Shimura

(10) Patent No.: US 9,098,034 B2
(45) Date of Patent: Aug. 4, 2015

(54) HEATER AND IMAGE HEATING DEVICE INCLUDING THE SAME

(75) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/004,106

(22) PCT Filed: Mar. 5, 2012

(86) PCT No.: PCT/JP2012/001498

§ 371 (c)(1),
(2), (4) Date: Sep. 9, 2013

(87) PCT Pub. No.: WO2012/120866

PCT Pub. Date: Sep. 13, 2012

(65) Prior Publication Data

US 2013/0343791 A1 Dec. 26, 2013

(30) Foreign Application Priority Data

Mar. 10, 2011 (JP) ..... 2011-053297

(51) Int. Cl.

| | |
|---|---|
| ***G03G 15/20*** | (2006.01) |
| ***H05B 3/03*** | (2006.01) |
| ***H05B 3/10*** | (2006.01) |
| ***H05B 1/02*** | (2006.01) |

(Continued)

(52) U.S. Cl.

CPC ..... *G03G 15/2053* (2013.01); *G03G 15/2042* (2013.01); *H05B 1/0241* (2013.01); *H05B 3/03* (2013.01); *H05B 3/06* (2013.01); *H05B 3/26* (2013.01); *H05B 2203/007* (2013.01); *H05B 2203/011* (2013.01); *H05B 2203/016* (2013.01)

(58) Field of Classification Search

None

See application file for complete search history.

(56) References Cited

U.S. PATENT DOCUMENTS 6,084,208 A * 7/2000 Okuda et al. ..... 219/216
6,456,819 B1 * 9/2002 Abe et al. ..... 399/329

(Continued)

FOREIGN PATENT DOCUMENTS

JP 10-177319 A 6/1998
JP 2005-209493 A 8/2005

(Continued)

OTHER PUBLICATIONS

JP 10-177319A, Yamazaki, Jun. 1998, partial translation.*

(Continued)

*Primary Examiner* — Joseph M Pelham
(74) *Attorney, Agent, or Firm* — Canon USA Inc IP Division

(57) ABSTRACT

In order to suppress excessive temperature rise at a non-sheet-passing region while suppressing the deterioration of fixability in case of heating small size sheets, a heater includes a first heat-generation line and a second heat-generation line, which are independently controllable, wherein the first heat-generation line is configured so that a plurality of heat-generation resistors having positive resistance-temperature characteristics is electrically connected in parallel to each other between a first electro-conductive element and a second electro-conductive element, and the heat-generation resistors are adjusted so that a heat-generation amount per unit length of the first heat-generation line in a lengthwise direction of the heater decreases from a recording material conveyance reference towards a end portion in the lengthwise direction, and an image heating device having the heater.

14 Claims, 6 Drawing Sheets

(51) Int. Cl.
*H05B 3/06* (2006.01)
*H05B 3/26* (2006.01)

(56) References Cited

U.S. PATENT DOCUMENTS

| | | | | |
|---|---|---|---|---|
| 8,126,383 | B2 * | 2/2012 | Kagawa | 399/329 |
| 8,150,304 | B2 * | 4/2012 | Kagawa et al. | 399/329 |
| 8,295,753 | B2 * | 10/2012 | Kagawa | 399/329 |
| 8,642,927 | B2 | 2/2014 | Shimura | |
| 8,653,422 | B2 | 2/2014 | Shimura et al. | |
| 2009/0230114 | A1 * | 9/2009 | Taniguchi et al. | 219/216 |
| 2013/0343790 | A1 | 12/2013 | Shimura | |
| 2013/0343791 | A1 | 12/2013 | Shimura | |
| 2014/0169846 | A1 | 6/2014 | Shimura et al. al. | |

FOREIGN PATENT DOCUMENTS

| | | | |
|---|---|---|---|
| JP | 2005-339840 | A | 12/2005 |
| JP | 2006-004860 | A | 1/2006 |
| JP | 2006-012444 | A | 1/2006 |
| JP | 2006-252897 | A | 9/2006 |
| JP | 2007-025474 | A | 2/2007 |
| JP | 2008-140702 | A | 6/2008 |
| JP | 4208772 | B2 | 1/2009 |
| JP | 2009-244867 | A | 10/2009 |
| JP | 2009-282335 | A | 12/2009 |
| JP | 2010-002857 | A | 1/2010 |
| JP | 2011-033939 | A | 2/2011 |

OTHER PUBLICATIONS

JP 2010-2857A, Kato et al, Jan. 2010, partial translation.*

* cited by examiner

| | HEAT-GENERATION PATTERN | | | | | | | | UNIT |
|---|---|---|---|---|---|---|---|---|---|
| | 1 | 2 | ~ | 47 | 48 | ~ | 93 | 94 | |
| a (LINE LENGTH) | 3.48 | 3.48 | ~ | 3.48 | 3.48 | ~ | 3.48 | 3.48 | mm |
| b (LINE WIDTH) | 0.374 | 0.377 | ~ | 0.468 | 0.468 | ~ | 0.377 | 0.374 | mm |
| c (INTERVAL) | 3.16 | 3.16 | ~ | 3.16 | 3.16 | ~ | 3.16 | 3.16 | mm |
| RESISTANCE VALUE | 400 | 397 | ~ | 320 | 320 | ~ | 397 | 400 | Ω |

HEATER AND IMAGE HEATING DEVICE INCLUDING THE SAME

TECHNICAL FIELD

The present invention relates to a heater suitable if utilized for a heat fixing device mounted on an image forming apparatus such as an electrophotographic copying machine, an electrophotographic printer, and to an image heating device that mounts the heater thereon.

BACKGROUND ART

As a fixing device to be mounted on a copying machine or a printer, there is a device having an endless belt, a ceramic heater which contacts an inner surface of the endless belt, and a pressure roller which forms a fixing nip portion together with the ceramic heater via the endless belt.

When small size sheets are continuously printed by the image forming apparatus that mounts thereon the fixing device, there occurs a phenomenon (non-sheet-passing portion temperature rise) that a temperature of a region where the sheets do not pass in a lengthwise direction of the fixing nip portion, is gradually rising.

When the temperature at the non-sheet-passing portion becomes too high, it may cause damages to respective portions in the device, or when printing is performed on large size sheets while the non-sheet-passing portion temperature rise is occurring, toner may be subjected to a high-temperature offset in a region corresponding to the non-sheet-passing portion of the small size sheets.

As a method for reducing the non-sheet-passing portion temperature rise, as discussed in PTL 1, there is devised a method for providing a first heat-generation line that has a resistance distribution in which a resistance value per unit length in a lengthwise direction gradually decreases from the central portion towards both end portions in a lengthwise direction of a heater, and a second heat-generation line that has a resistance distribution in which a resistance value per unit length in the lengthwise direction gradually increases from the central portion towards the both end portions in the lengthwise direction of the heater, and independently controlling the states of power supply, and shutoff of the respective heat-generation lines.

CITATION LIST

Patent Literature

PTL 1: Japanese Patent No. 4208772

SUMMARY OF INVENTION

Technical Problem

In a configuration illustrated in the PTL 1, however, only heat-generation distributions depending on ratios of electric powers to be supplied to the first heat-generation line and the second heat-generation line can be formed. Hence, in a case where the small size sheets are passed, a temperature rise of the non-sheet-passing region can be suppressed by supplying more power to the first heat-generation line. However, when more power is supplied to the first heat-generation line, fixability of end portion of a sheet-passing region may be lowered.

Conversely, the fixability of the end portion of a sheet-passing region can be improved, by supplying more power to the second heat-generation line. However, when more power is supplied to the second heat-generation line, temperatures of the non-sheet-passing portion region will rise.

Therefore, when securing of the fixability and suppressing of the temperature rise of the non-sheet-passing portion cannot be attained at the same time, processing for lowering a throughput of the image forming apparatus needed to be performed.

Thus, an object of the present invention is to provide a heater of which the effect of suppressing the non-sheet-passing portion temperature rise is high while suppressing the decline of the fixability, and an image heating device including the heater.

Solution to Problem

According to an aspect of the present invention, a heater used for an image heating device includes a substrate, a first heat-generation line provided on the substrate along a lengthwise direction of substrate, and a second heat-generation line provided along the lengthwise direction at a position different from the first heat-generation line in a widthwise direction of the substrate and having a heat-generation distribution different from that of the first heat-generation line. The first heat-generation line and the second heat-generation line are controllable independently. At least the first heat-generation line out of the first heat-generation line and the second heat-generation line includes a first electro-conductive element provided on the substrate along the lengthwise direction, a second electro-conductive element provided along the lengthwise direction at a position on the substrate different from the first electro-conductive element in the widthwise direction, and a plurality of heat-generation resistors having positive resistance-temperature characteristics and electrically connected in parallel between the first electro-conductive element and the second electro-conductive element. The plurality of heat-generation resistors is configured such that a heat-generation amount per unit length in the lengthwise direction decreases from recording material conveyance reference towards end portions in the lengthwise direction.

Advantageous Effects of Invention

According to the present invention, a heater and an image heating device in which the effect of inhibiting the non-sheet-passing portion temperature rise while inhibiting the decline of the fixability is high can be provided.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

DESCRIPTION OF EMBODIMENTS

Various exemplary embodiments, features, and aspects of the invention will be described in detail below with reference to the drawings.

Figure 1:
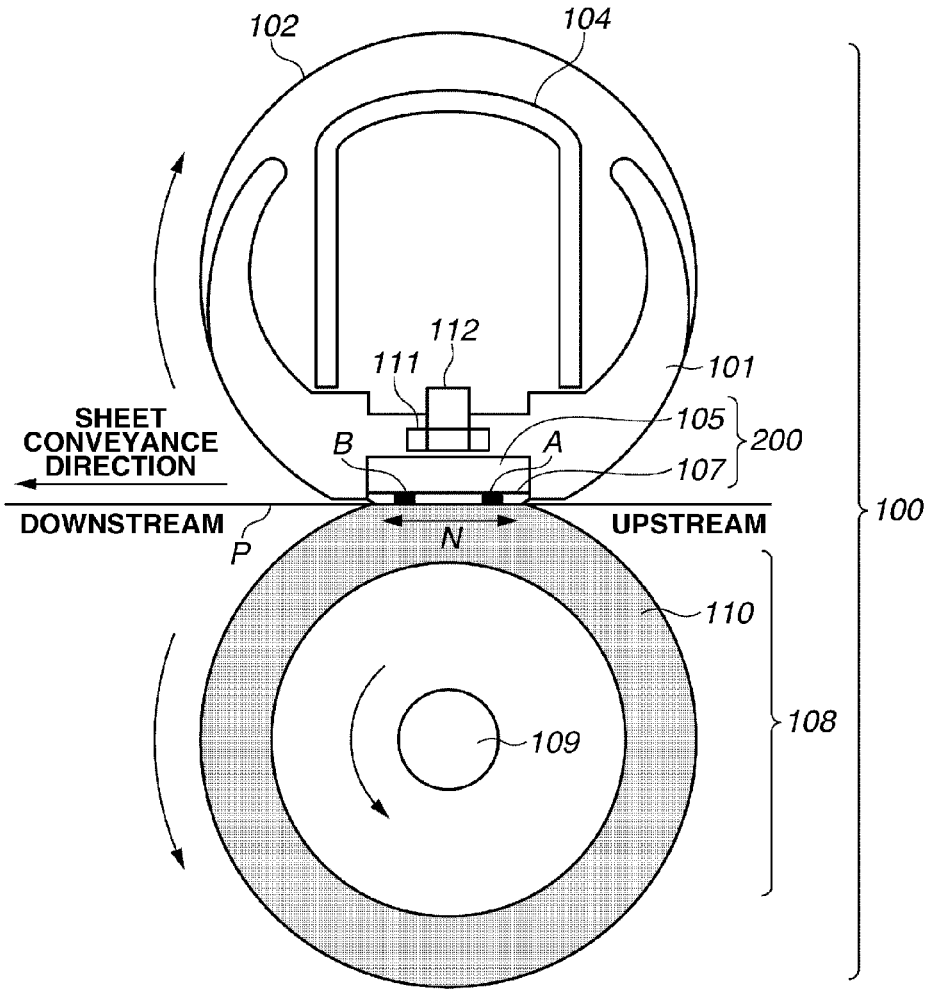
FIG. 1 is a cross-sectional diagram of an image heating device according to the present invention.

FIG. 1 is a cross-sectional diagram of a fixing device 100 as an example of an image heating device.

The fixing device 100 includes a cylindrical film (endless belt) 102, a heater 200 that contacts an inner surface of the film 102, and a pressure roller (nip portion forming member) 108 that forms a fixing nip portion N together with the heater 200 via the film 102. Material of a base layer of the film is a heat-resistant resin such as polyimide, or a metal such as stainless steel.

The pressure roller 108 includes a mandrel 109 made of material such as iron or aluminum, and an elastic layer 110 made of material such as silicone rubber. The heater 200 is held by a holding member 101 made of heat-resistant resin. The holding member 101 has a guide function for guiding the rotation of the film 102. The pressure roller 108 receives a power from a motor (not illustrated) and rotates in a direction of an arrow. The film 102 is driven and rotated by the rotation of the pressure roller 108.

The heater 200 includes a heater substrate 105 made of ceramic, a heat-generation line A (first heat-generation line) and a heat-generation line B (second heat-generation line) that are formed using heat-generation resistors on the substrate, and an insulating (glass in the present exemplary embodiment) surface protective layer 107 that covers the heat-generation lines A and B.

A temperature detection element 111 such as a thermistor contacts a sheet-passing region of available minimum size sheets (an envelope DL: 110 mm width according to the present exemplary embodiment) set in a printer, on the back surface side of the heater substrate 105. An electric power to be supplied from a commercial alternating current (AC) power source to the heat-generation line is controlled according to a detected temperature by the temperature detection element 111.

A recording material (paper sheet) P that carries unfixed toner image is heated while being sandwiched and conveyed in the fixing nip portion N and is subjected to fixing processing. A safety element 112 such as a thermo-switch also contacts the back surface side of the heater substrate 105. The safety element 112 operates to shut off power feed lines to the heat-generation lines, when the temperature of the heater abnormally rises.

The safety element 112, similar to the temperature detection element 111, contacts the sheet-passing region of the minimum size sheet. A metallic stay 104 is used to apply pressure of a spring (not illustrated) onto the holding member 101.

The fixing device described in the present exemplary embodiment is intended to be mounted on a printer that can deal with a sheet width 297 mm when A3 size sheet (297 mm*420 mm) is fed longitudinally (i.e., conveyed such that long side becomes parallel to a conveying direction). The fixing device is designed to be capable of dealing with a sheet width of 210 mm when, for example, AS size (148 mm*210 mm) sheet, i.e., the sheet with a sheet width narrower than A3 size is fed transversely.

Hereinafter, a sheet size with the largest sheet width among sheets which the fixing device can deal with (A3 size sheet in the present exemplary embodiment) is referred to as a maximum size sheet, and a sheet size with smaller sheet width than the maximum size sheet (A5 size sheet in the present exemplary embodiment) is referred to as a small size sheet.

EXAMPLE 1

Figure 2A:
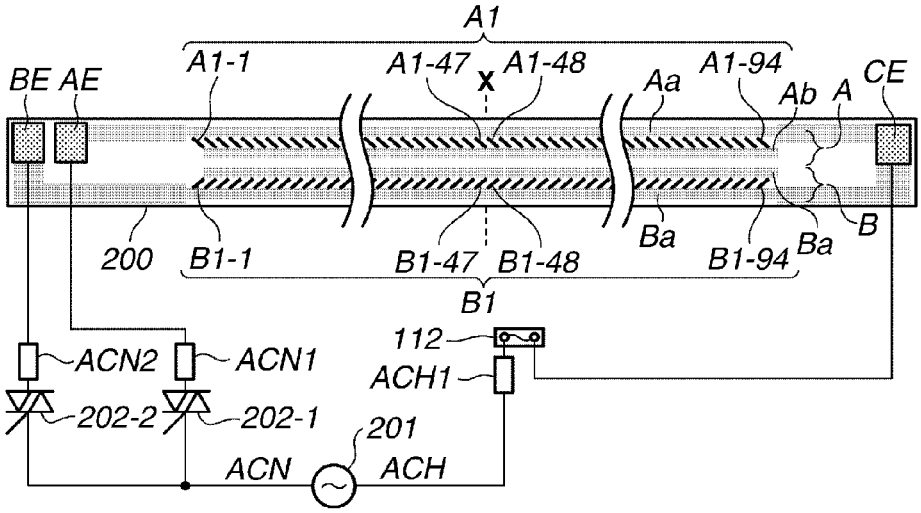
FIG. 2A is a diagram illustrating a configuration of a heater according to a first exemplary embodiment.
Figure 2B:
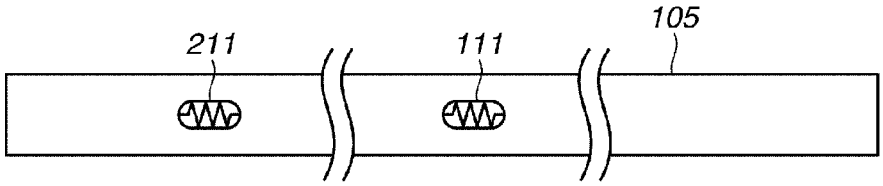
FIG. 2B is a diagram illustrating a configuration of the heater according to the first exemplary embodiment.
Figure 2C:
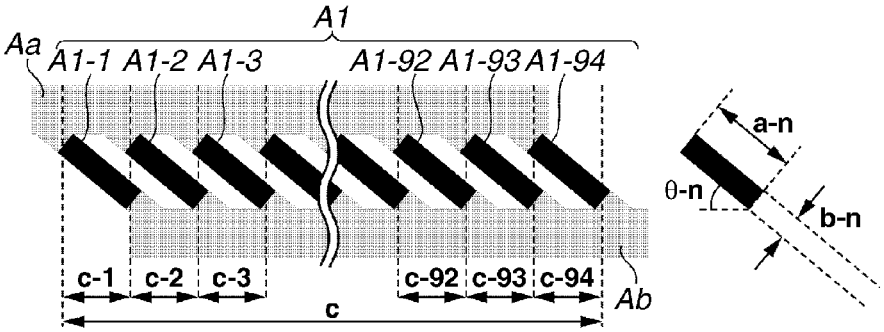
FIG. 2C is a diagram illustrating a configuration of the heater according to the first exemplary embodiment.

FIGS. 2A, 2B, and 2C are schematic diagrams illustrating a driving circuit and a control circuit of the heater according to the first exemplary embodiment. A commercial AC power source 201 is connected to the image forming apparatus. Power supply to the heater 200 is performed by energization/shutoff of a triac 202-1 and a triac 202-2. The triac 202-1 and the triac 202-2 are controlled by a control unit (central processing unit (CPU)) (not illustrated).

A temperature to be detected by the thermistor 111 is detected as a voltage divided with resistance. In internal processing of the CPU (not illustrated), electric power to be supplied is calculated by, for example, a proportional integral (PI) control, based on detected temperature of the thermistor 111 and set temperature of the heater 200. Furthermore, the electric power is converted into control levels of a phase angle (phase control), and a wave number (wave number control) corresponding to a power ratio to be supplied, and the triac 202-1 and the triac 202-2 are controlled according to the control condition thereof.

The heat-generation resistors and electro-conductive elements formed on the ceramic substrate 105 illustrated in FIG. 2A will be described. Resistance-temperature characteristics of the heat-generation resistors in the heat-generation line A and the heat-generation resistors in the heat-generation line B each have positive temperature coefficients (PTC).

The heat-generation line A (first heat-generation line) has one heat-generation block A1, and the heat-generation line B (second heat-generation line) also has one heat-generation block B1. Further, electric powers to be supplied to the heat-generation line A and the heat-generation line B are designed to be independently controllable, by the triac 202-1 and the triac 202-2.

In the heat-generation line A, electric power is supplied from electrodes AE and CE to which electrical power supply connectors are connected. In the heat-generation line B, electric power is supplied from electrodes BE and CE to which electrical power supply connectors are connected. ACN1, ACN2, and ACH1 are connectors for connecting the heater 200 and the driving circuit.

The heat-generation line A includes an electro-conductive pattern Aa (first electro-conductive element of the heat-generation line A) provided along a lengthwise direction of the substrate, and an electro-conductive pattern Ab (second electro-conductive element of the heat-generation line A) provided along the lengthwise direction of the substrate at a position different from the electro-conductive pattern Aa in a widthwise direction of the substrate.

Between the electro-conductive pattern Aa and the electro-conductive pattern Ab, a plurality of (94 resistors in the present exemplary embodiment) heat-generation resistors (A1-1 to A1-94) are electrically connected in parallel, which forms a heat-generation block A1. The configuration of the heat-generation line B is similar to that of the heat-generation line A, and description thereof will not be repeated.

FIG. 2B illustrates a first thermistor 111 and a second thermistor 211 (end portion thermistor 211), which contact the back surface of the ceramic substrate 105. The thermistor 111 is provided near the center (recording material conveyance reference position X as will be described below) of the heat-generation line A and the heat-generation line B. The thermistor 211 is provided near the end portion of the heat-generation line A and the heat-generation line B, and is provided to detect end portion temperatures of the heater 200.

FIG. 2C is a detailed diagram of the heat-generation block A1. Between the electro-conductive element Aa and the electro-conductive element Ab, the plurality of (94 resistors in the present exemplary embodiment) heat-generation resistors (A1-1 to A1-94) is electrically connected in parallel, which forms the heat-generation block A1, which also is the heat-generation line A in the present exemplary embodiment.

The heat-generation block A1 has 94 resistors from a heat-generation resistor A1-1 with a line length A-1, a line width B-1, and an inclination theta-1, to a heat-generation resistor A1-94 with a line length A-94, a line width B-94, and an inclination theta-94, which are aligned at intervals C-1 to C-94, and are connected in parallel via the electro-conductive elements.

A heat-generation block length, as indicated by C in FIG. 2C, is defined as a length from the center of the short side of the heat-generation resistor A1-1 located at left-end, to the center of the short side of the heat-generation resistor A1-94 located at right-end. In the heater 200, the intervals C-1 to C-94 of the heat-generation resistors are equal, which are set to be C/94.

The heat-generation line A has a heat-generation distribution in which a heat-generation amount per unit length decreases from the recording material conveyance reference X towards the end portion of the heat-generation line A. In the heat-generation block A1, heat-generation resistors (A1-47, A1-48) located closer to the conveyance reference X have lower resistance values, and heat-generation resistors (A1-1, A1-94) located closer to the end portion of the heat-generation line A have higher resistance values.

The table illustrated in FIG. 2C illustrates an example method for adjusting a heat-generation amount per unit length of the heat-generation block A1. A length a-n, and an interval c-n of a heat-generation resistors is constant, and the resistance value of the heat-generation resistor in the lengthwise direction is adjusted by adjusting a line width b-n. The resistance value of the heat-generation resistor, since it is proportional to the length/line-width, may be adjusted by adjusting the length of the heat-generation resistor similarly to the line width.

Further, a distribution of electric current which flows through the heat-generation resistors can be made uniform, by making a shape of the heat-generation resistors rectangular as illustrated in FIG. 2C.

For example, in a case where a heat-generation resistor has a parallelogram shape, electric current flows more through the shortest path, and as a result, the distribution of electric current, which flows through the heat-generation resistors, may not be uniform. However, the effect of suppressing the non-sheet-passing portion temperature rise of the present invention can be obtained even when the heat-generation resistors in the parallelogram shape are used, and the shape of the heat-generation resistors is not limited to rectangle.

Alternatively, a heat-generation resistor in a curved shape may be used. Further, to suppress minute unevenness of the heat-generation distribution in the lengthwise direction of the substrate, adjacent heat-generation resistors are arranged to overlap each other in the lengthwise direction of the substrate. In the present exemplary embodiment, as illustrated in FIG. 2C, the adjacent heat-generation resistors are arranged so that the center of the short side of the heat-generation resistor and the center of the short side of the neighboring heat-generation resistor overlap each other.

The heat-generation line B has a heat-generation distribution in which a heat-generation amount per unit length increases from the recording material conveyance reference X towards the end portions of the heat-generation line B. The heat-generation block B1, which is also the heat-generation line B in the present exemplary embodiment, heat-generation resistors (B1-47 and B1-48) located closer to the conveyance reference X have higher resistance values, and heat-generation resistors (B1-1 and B1-94) located closer to the end portion of the heat-generation line B have lower resistance values. A method for adjusting resistance value of the heat-generation line B is similar to that of the heat-generation line A, and description thereof will not be repeated.

Figure 3A:
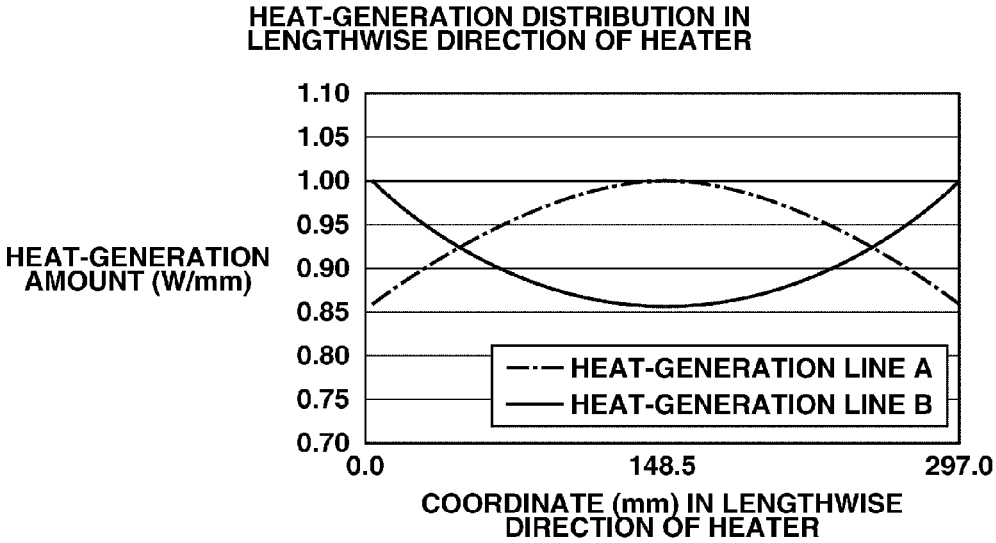
FIG. 3A is a graph illustrating a heat-generation distribution of the heater according to the first exemplary embodiment.
Figure 3B:
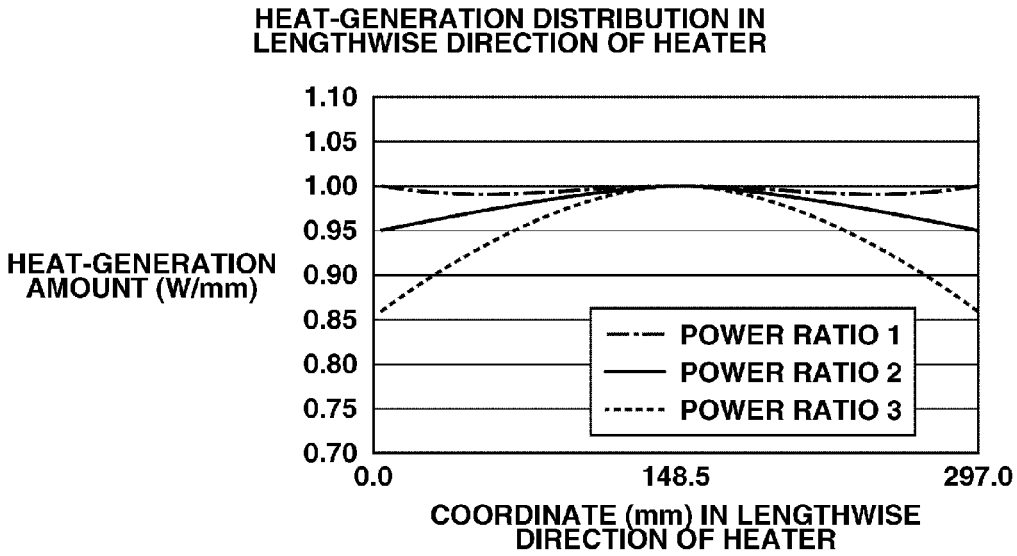
FIG. 3B is a graph illustrating a heat-generation distribution of the heater according to the first exemplary embodiment.

FIG. 3A illustrates heat-generation distributions of the heat-generation line A and the heat-generation line B. FIG. 3B illustrates heat-generation distributions in a case where the heat-generation line A and the heat-generation line B are controlled based on a power ratio 1 (power ratio is 1:1), a power ratio 2 (power ratio 2:1), and a power ratio 3 (power ratio 1:0), and controlled so that, at the position of coordinate 148.5 mm that is the position of the recording material conveyance reference X, a heat-generation amount 1.00 (W/mm) is generated.

The power ratio 1 generates a uniform heat-generation distribution in the lengthwise direction of the heater 200, since power duties to be supplied to the heat-generation line A and the heat-generation line B are equal. The power ratio 2 generates a heat-generation distribution in which a heat-generation amount per unit length in the lengthwise direction gradually decreases from the central portion towards both end portions in the lengthwise direction of the heater, since power duty to be supplied to the heat-generation line B is half of power duty to be supplied to the heat-generation line A. In this case, a heat-generation distribution for suppressing the end portion temperature rise is obtained. The power ratio 3 generates a heat-generation distribution when power is supplied to only the heat-generation line A, which is equal to the heat-generation distribution of the heat-generation line A.

The heat-generation distribution illustrated in FIG. 3B, which is the heat-generation distribution of the heater 200 while a recording material is not being passed, can be also formed by the heater indicated by the PTL 1. However, in a case of the heater indicated by the PTL 1, a heat-generation distribution which can be formed is the same as that in FIG. 3B (when a resistance-temperature coefficient of the heat-generation resistor is zero), even when the recording material is being passed.

Figure 4:
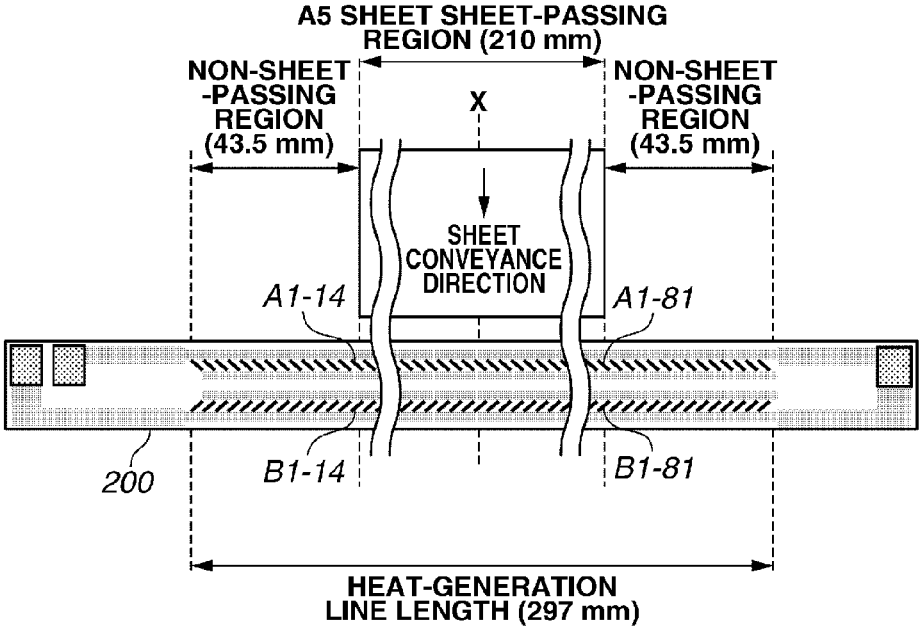
FIG. 4 illustrates a relationship between the heater and a sheet size according to the first exemplary embodiment.

FIG. 4 is a diagram illustrating the non-sheet-passing portion temperature rise of the heater 200. FIG. 4 illustrates a case where AS size sheet (210 mm* 148 mm) is conveyed in a longitudinal direction with reference to the central portion of the heat-generation line as an example.

A sheet feed cassette (not illustrated) provided in the image forming apparatus includes a position regulating plate for regulating a position of the sheets, feeds the recording sheets from a predetermined position for each size of the stacked recording sheets, and conveys them so that the recording sheets pass through a predetermined position of the image heating device.

Although, in the present exemplary embodiment, a case where the central portion is used as the reference has been described, even when sheet conveyance is performed using either left- or right-end portion as the reference, the non-sheet-passing portion temperature rise similarly occurs at an end portion on an opposite side to the reference. For example, when the sheet conveyance is performed using the left-end as the reference, the recording material (sheet) conveyance reference X is the left-end.

The heater 200 in FIG. 4, in order to deal with a case where an A3 size sheet (about 297 mm * 420 mm) is conveyed in the longitudinal direction, has a heat-generation line length 297 mm for a sheet width 297 mm In a case where a AS size sheet with a sheet width 210 mm (148 mm *210 mm) is conveyed in the longitudinal direction, on the heater 200 having the heat-generation line length 297 mm, the non-sheet-passing regions 43.5 mm are generated at both end portions of the heat-generation line.

The temperature control of the heater 200 is performed based on the output of the thermistor 111 provided near the center of the sheet-passing portion. Since heat is not taken from the non-sheet-passing portions by the sheets, temperatures of the non-sheet-passing portions rise higher as compared with the temperature at the sheet-passing portion.

The end portions of the AS size sheet pass over the heat-generation resistors A1-14 and A1-81 of the heat-generation line A1. Similarly, the end portions of the AS size sheet pass over the heat-generation resistors B1-14 and B1-81 of the heat-generation line B1.

Figure 5A:
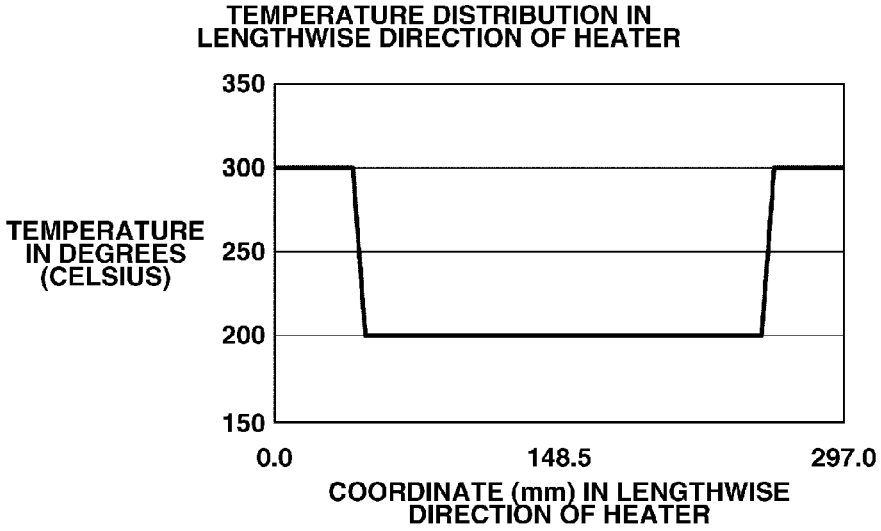
FIG. 5A is a graph illustrating the effect of suppressing a non-sheet-passing portion temperature rise of the heater according to the first exemplary embodiment.
Figure 5B:
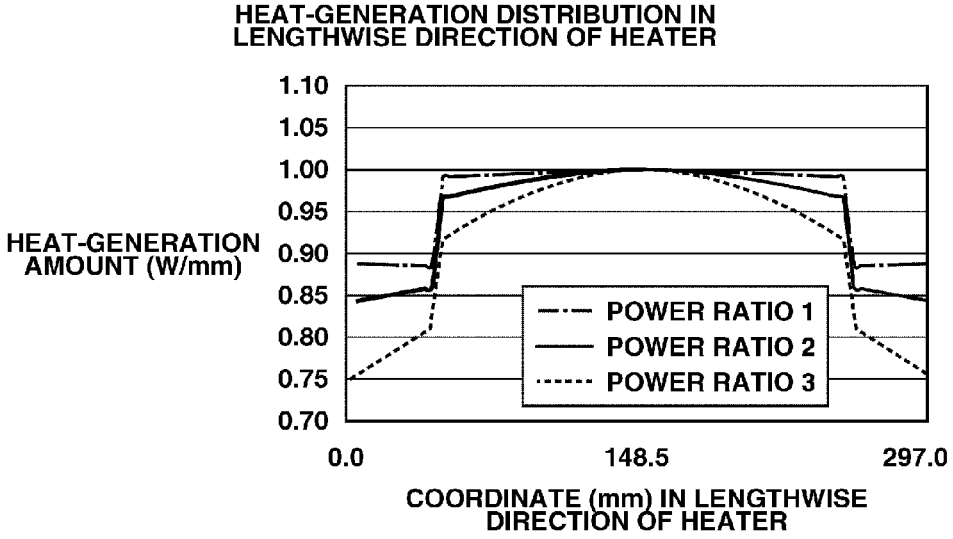
FIG. 5B is a graph illustrating the effect of inhibiting the non-sheet-passing portion temperature rise of the heater according to the first exemplary embodiment.

FIGS. 5A and 5B illustrate simulation results of the effect of suppressing the non-sheet-passing portion temperature rise of the heater 200. In FIGS. 5A and 5B, in order to explain the effect of suppressing the non-sheet-passing portion temperature rise of the heater 200, conditions such as temperature distribution are simplified.

FIG. 5A illustrates a temperature distribution when temperatures of the non-sheet-passing regions (regions of 43.5 mm) at both ends of the heat-generation line have risen 100 degrees (Celsius) relative to the sheet-passing region, in the sheet-passing state illustrated in FIG. 4. The temperature of the sheet-passing region is controlled at 200 degrees (Celsius), and the temperature of the non-sheet-passing regions has risen to 300 degrees (Celsius).

When the heat-generation resistor temperatures of the non-sheet-passing portions reach 300 degrees (Celsius) or higher, there is a possibility that heat-resistant temperatures of the roller portion 110 made of heat-resistant rubber elastic body of the pressure roller 108, the film 102, the film guide 101, and the like reach their limits, and thus the fixing device may be damaged. Therefore, the temperature of the non-sheet-passing portion temperature rise is set at 300 degrees (Celsius).

Actually, continuous temperature distribution exists at the end portions of the non-sheet-passing regions or the sheet-passing region. For the sake of simplification, the temperature distribution illustrated in FIG. 5A assumes a case where temperature change from 300 degrees (Celsius) to 200 degrees (Celsius) has occurred at the heat-generation resistors A1-14 and A1-81 of the heat-generation line A1, and the heat-generation resistors B1-14 and B1-81 of the heat-generation line B1, which overlap the end portions of the AS size sheet. Further, the heat-generation resistors have a resistance-temperature coefficient of 1500 ppm.

FIG. 5B illustrates heat-generation distributions (when power ratios are set to the power ratio 1, the power ratio 2, and the power ratio 3) in the lengthwise direction of the heater 200 when the temperature distribution in FIG. 5A is generated.

As compared to the temperature rise of 200 degrees (Celsius) of the heat-generation resistors of the sheet-passing region, the temperature rise of the heat-generation resistors of the non-sheet-passing regions is 300 degrees (Celsius), which is higher than that of the sheet-passing region. Consequently, the resistance values of the heat-generation resistors of the non-sheet-passing regions become higher as compared with those of the heat-generation resistors of the sheet-passing region.

More specifically, the resistance values of the heat-generation resistors (A1-1 to A1-13, A1-82 to A1-94, B1-1 to B1-13, and B1-82 to B1-94) of the non-sheet-passing regions become greater relative to those of the heat-generation resistors of the sheet-passing region. The reason for that is the heat-generation resistors have a positive temperature coefficient (PTC).

The heat-generation resistors of the heat-generation line A and the heat-generation line B, which have PTCs, are connected in parallel between the electro-conductive elements. Therefore, when the resistance values of the heat-generation resistors of the non-sheet-passing regions increase relative to those of the heat-generation resistors of the sheet-passing region, electric current flowing through the heat-generation resistors of the non-sheet-passing regions decreases, and thereby the heat-generation amounts of the non-sheet-passing regions can be suppressed. Therefore, even in a case of the power ratio 1, which generates uniform heat-generation distribution, as illustrated in FIG. 5B, the heat-generation amounts of the non-sheet-passing regions can be suppressed, while suppressing the decrease of heat-generation amount of the sheet-passing region.

Furthermore, in cases of the power ratio 2 and the power ratio 3, as illustrated in FIG. 5B, the heat-generation amounts of the non-sheet-passing regions can be further suppressed, and as a result, the temperature rise of the non-sheet pass regions can be suppressed.

As described above, the heat-generation distributions illustrated in FIG. 3B which are the heat-generation distributions of the heater 200 while the recording material is not passed, can be formed even by the heater indicated by the PTL 1. However, in case of the heater indicated by the PTL 1, heat-generation distributions which can be formed are the same as those in FIG. 3B, even when the recording material is passed (when resistance-temperature coefficients of the heat-generation resistors are zero).

Further, when the resistance-temperature coefficients of the heat-generation resistors are not zero but are PTCs, the heat-generation amounts of the non-sheet-passing portions will increase. In contrast, the heat-generation distributions such as the ones in FIG. 5B, which cannot be formed by the heater described in the PTL 1, can be formed with the heater 200 in the present exemplary embodiment. Accordingly, the temperature rise of the non-sheet-passing regions can be suppressed, while suppressing the drop in temperatures within the sheet-passing region.

Figure 6:
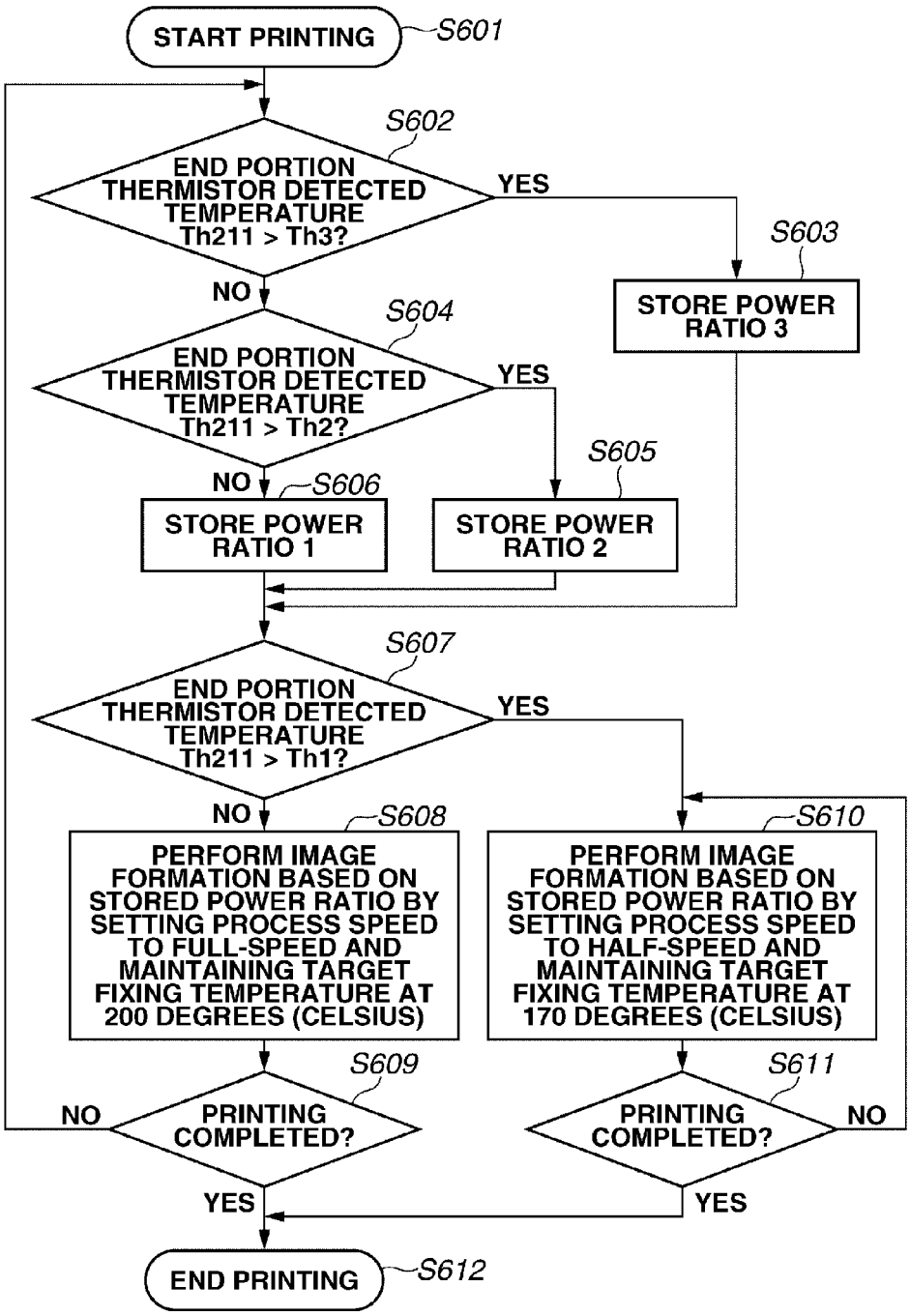
FIG. 6 is a control flowchart of the heater according to the first exemplary embodiment.

FIG. 6 is a flowchart illustrating a control sequence of the fixing device 100, by the control unit (CPU) (not illustrated). In the first exemplary embodiment, the image forming apparatus using two sheet sizes of A3-size (sheet feeding in the longitudinal direction) and A5-size (sheet feeding in the transverse direction) as standard form sheets is described.

In step S601, the control unit determines whether a request for start of printing is made. If the request is made, the processing proceeds to step S602. In step S602, the control unit determines whether a detected temperature Th211 of the end portion thermistor 211 is higher than a threshold temperature Th3. If the detected temperature Th211 is higher than Th3 (YES in step S602), the processing proceeds to step S603. In step S603, the control unit stores the power ratio 3. If the detected temperature Th211 is Th3 or lower (NO in step S602), the processing proceeds to step S604.

In step S604, the control unit determines whether the detected temperature Th211 of the end portion thermistor 211 is higher than a threshold temperature Th2. If the detected temperature Th211 is higher than Th2 (YES in step S604), the processing proceeds to step S605. In step S605, the control unit stores the power ratio 2. If the detected temperature Th211 is Th2 or lower (NO in step S604), the processing proceeds to step S606. In step S606, the control unit stores the power ratio 1.

In step S607, the control unit detects whether the detected temperature Th211 of the end portion thermistor exceeds Th1. If the detected temperature Th211 has exceeded Th1, it indicates a case where the end portion temperature rise could not be sufficiently suppressed, even when controlled based on the power ratio 3. In this case, the threshold temperatures satisfy Th1>Th3>Th2.

If the detected temperature Th211 is Th1 or lower (NO in step S607), the processing proceeds to step S608. In step S608, image forming is performed by setting an image formation process speed to full-speed (a maximum speed set for the image forming apparatus), and controlling the heater so that the detected temperature Th111 of the thermistor 111 provided near the conveyance reference X maintains a target temperature 200 degrees Celsius. At this time, the control unit controls the triac 202-1 and the triac 202-2 based on the stored power ratio so that the detected temperature Th111 of the thermistor 111 maintains the target temperature 200 degrees Celsius.

If the temperature Th211 of heater end portion is higher than Th1 (YES in step S607), the processing proceeds to step S610. In step S610, image forming is performed by lowering a throughput of the image forming apparatus, setting the image forming process speed to half-speed, and lowering the target fixing temperature down to 170 degrees Celsius. When the image forming process speed is set at half-speed, the fixability is obtained even at lower temperatures as compared with the fixability obtained at the full-speed. As a result, the target fixing temperature can be lowered, and the temperatures of the non-sheet-passing portions can be also suppressed.

The above processing is performed repetitively, until printing completion is determined in steps S609 and S611, and a power ratio, a throughput, an image forming process speed, a target fixing temperature of the image forming apparatus are set.

Further, similar effects can be obtained even in the image forming apparatus in which a sheet size other than A3 and A5 sizes is set as the standard form sheet. In a configuration in which the sheet size set in a sheet feed tray (not illustrated) is detectable, setting of control may be individually performed so that the non-sheet-passing portion temperature rise can be prevented for each size.

By performing a control of the flowchart illustrated in FIG. 6, the effect of suppressing the non-sheet-passing portion temperature rise caused by a small size sheet (A5) can be obtained, while dealing with a maximum size sheet (A3).

In this manner, at least the first heat-generation line out of the first heat-generation line and the second heat-generation line, includes a first electro-conductive element provided along the lengthwise direction, a second electro-conductive element provided along the lengthwise direction at a position different from the first electro-conductive element in a widthwise direction, and a plurality of heat-generation resistors having positive resistance-temperature characteristics and electrically connected in parallel between the first electro-conductive element and the second electro-conductive element. Since at least the one of resistance values of the plurality of heat-generation resistors, and intervals of the heat-generation resistors are adjusted so that a heat-generation amount per unit length in the lengthwise direction, decreases from the recording material conveyance reference towards the end portions in the lengthwise direction, the non-sheet-passing portion temperature rise can be suppressed while securing the fixability.

EXAMPLE 2

Next, a second exemplary embodiment in which a heater to be mounted on the image heating device has been changed will be described. In regard to a configuration similar to the first exemplary embodiment, description thereof will not be repeated.

Figure 7:
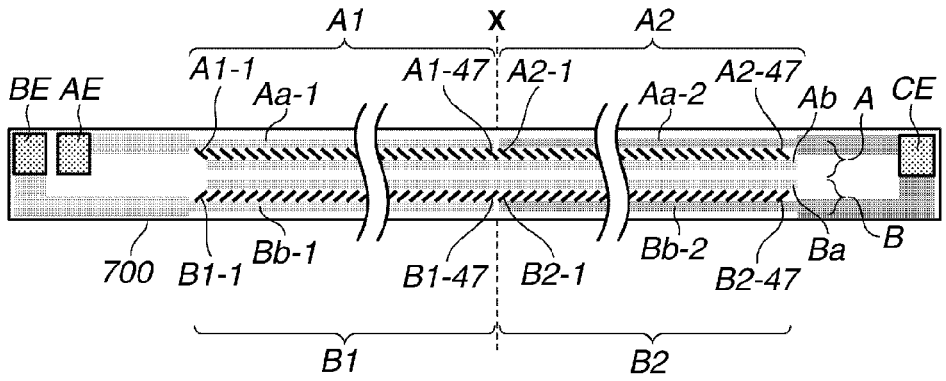
FIG. 7 is a diagram illustrating a configuration of a heater according to a second exemplary embodiment.

FIG. 7 illustrates a configuration of a heater 700 according to the second exemplary embodiment. A heat-generation line A (a first heat-generation line) includes two heat-generation blocks A1 and A2 connected in series to each other. A heat-generation line B (a second heat-generation line) also includes two heat-generation blocks B1 and B2 connected in series to each other. Further, electric powers to be supplied to the heat-generation line A and the heat-generation line B, are independently controlled by the triac 202-1 and the triac 202-2.

To the heat-generation line A, power is supplied from electrodes AE and CE to which the electrical power supply connectors are connected. To the heat-generation line B, power is supplied from the electrode BE and CE to which the electrical power supply connectors are connected.

The heat-generation line A includes an electro-conductive element Aa (a first electro-conductive element of the heat-generation line A) provided along the lengthwise direction of the substrate, and an electro-conductive element Ab (a second electro-conductive element of the heat-generation line A) provided along the lengthwise direction of the substrate at a position different from the electro-conductive element Aa in the widthwise direction of substrate. The electro-conductive element Aa is divided into two lines (Aa-1, Aa-2) in the lengthwise direction of the substrate. A configuration of the heat-generation line B is similar to that of the heat-generation line A, and description thereof will not be repeated.

The heat-generation line A has a heat-generation distribution in which a heat-generation amount decreases from the conveyance reference X towards the end portions of the heat-generation line A. In the heat-generation block A1, heat-generation resistors (A1-47) located closer to the conveyance reference X have lower resistance values, and heat-generation resistors (A1-1) located closer to the end portion of the heat-generation line A have higher resistance values. In the heat-generation block A2, heat-generation resistors (A2-1) located closer to the conveyance reference X have lower resistance values, and heat-generation resistors (A2-47) located closer to the end portion of the heat-generation line A have higher resistance values.

The heat-generation line B has a heat-generation distribution in which heat-generation amounts increase from the conveyance reference X towards the end portions of the heat-generation line B.

In the heat-generation block B1, heat-generation resistors (B1-47) located closer to the conveyance reference X have higher resistance values, and heat-generation resistors (B1-1) located closer to the end portion of the heat-generation line B have lower resistance values. In the heat-generation block B2, heat-generation resistors (B2-1) located closer to the conveyance reference X have higher resistance values, and heat-generation resistors (B2-47) located closer to the end portion of the heat-generation line B have lower resistance values.

Like the heater 700 according to the present exemplary embodiment, in a heater in which the heat-generation line is divided into a plurality of heat-generation blocks, and the plurality of heat-generation blocks are connected in series, there is an advantage that materials with a low sheet resistance value can be used, as the material of the heat-generation resistors. Like the heater 700 according to the present exemplary embodiment, also in a heater in which the heat-generation line is divided into a plurality of heat-generation blocks, and the plurality of heat-generation blocks are connected in series, the non-sheet-passing portion temperature rise can be suppressed while securing the fixability.

EXAMPLE 3

Next, a third exemplary embodiment in which a heater to be mounted on the image heating device is changed will be described. In regard to a configuration similar to that in the first exemplary embodiment, description thereof will not be repeated.

Figure 8:
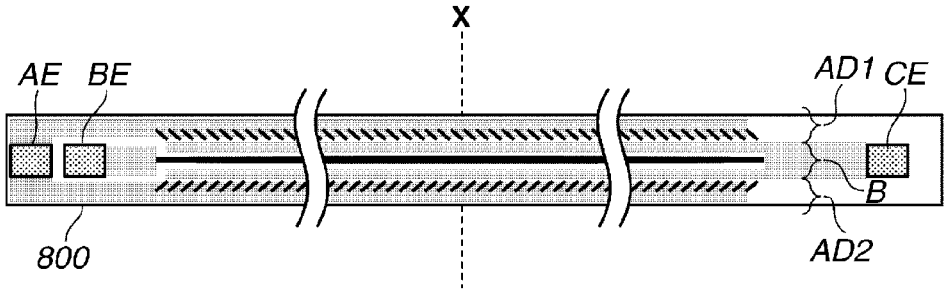
FIG. 8 is diagram illustrating a configuration of a heater according to a third exemplary embodiment.

FIG. 8 illustrates a configuration of a heater 800 according to the third exemplary embodiment. The heater 800 is provided with two first heat-generation lines (AD1 and AD2). The first heat-generation lines AD1 and AD2 connected in parallel are supplied with power via the electrode AE and electrode CE. The second heat-generation line B is supplied with power via the electrode BE and electrode CE.

The heat-generation lines AD1 and AD2 are formed at symmetrical positions with reference to the center in the widthwise direction of the heater to have symmetrical heat-generation distributions with reference to the center in the widthwise direction (in the recording material conveying direction) of the heater 800. The heat-generation lines AD1 and AD2, similar to the heat-generation line A1 of the heater 200 described in the first exemplary embodiment, have heat-generation distributions in which a heat-generation amount gradually decreases from the conveyance reference X towards both end portions in the lengthwise direction of the heater.

The heat-generation line B is formed by one line of the heat-generation resistors, and has a heat-generation distribution in which heat-generation amounts increase from the conveyance reference X towards both end portions in the lengthwise direction. The heat-generation line B has a heat-generation distribution in which heat-generation amounts increase from the conveyance reference X towards the end portions of the heat-generation line B.

Even if a configuration such as the one illustrated in FIG. 8 is used as the second heat-generation line B, if the first heat-generation line has a configuration similar to that of the first exemplary embodiment, a heat-generation distribution such as the one illustrated in FIG. 5B can be formed. Further, if the first heat-generation lines are arranged symmetrically to the widthwise direction of the heater, like illustrated as the present exemplary embodiment, heat-generation distributions thereof in the widthwise direction of the heater can be made symmetrical to each other, and the heater can be made to have a high durability.

EXAMPLE 4

Figure 9:
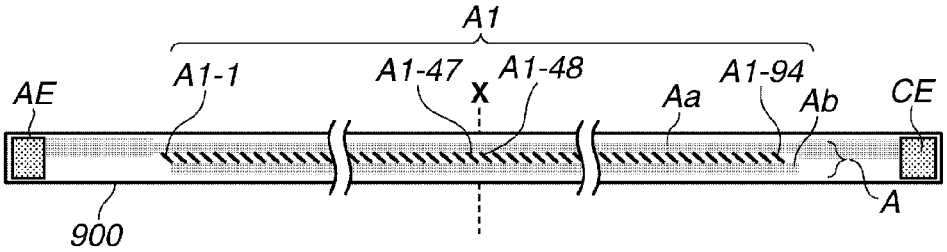
FIG. 9 is a diagram illustrating a configuration of a heater according to a fourth exemplary embodiment.

FIG. 9 illustrates a configuration of a heater 900 according to a fourth exemplary embodiment. The heat-generation line A is supplied with electric power via the electrode AE and electrode CE. Since the heat-generation line A is similar to the heat-generation line A of the heater 200 according to the first exemplary embodiment, description thereof will not be repeated.

The heat-generation line A generates a heat-generation distribution in which a heat-generation amount per unit length in the lengthwise direction gradually decreases from the conveyance reference X (the center in the lengthwise direction of the heater according to the present exemplary embodiment) towards both end portions.

The heater 900, since the heat-generation line on the heater has one line, cannot set heat-generation distributions such as the ones based on the power ratios 1 to 3 illustrated in the first to the third exemplary embodiments. However, it is useful for a case where the heater 900 is used for an image heating device which places importance on the small size sheets, while dealing with maximum size sheets such as A3. A printing throughput of large size sheets or, end portion fixability may be reduced, but printing speed of the small size sheets can be enhanced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-053297 filed Mar. 10, 2011, which is hereby incorporated by reference herein in its entirety.

The invention claimed is:

1. A heater for an image heating device that heats a recording material on which an image is carried while sandwiching and conveying the recording material at a nip portion, comprising:

a substrate having lengthwise and widthwise dimensions;

a first heat-generation line provided on the substrate along a lengthwise direction of the substrate; and a second heat-generation line provided along the lengthwise direction at a position different from the first heat-generation line in a widthwise direction of the substrate and configured to have a heat-generation distribution different from that of the first heat-generation line;

wherein the first heat-generation line and the second heat-generation line are controllable independently, wherein at least the first heat-generation line out of the first heat-generation line and the second heat-generation line includes, a first electro-conductive element provided on the substrate along the lengthwise direction, a second electro-conductive element provided along the lengthwise direction at a position different from the first electro-conductive element in the widthwise direction on the substrate, a plurality of heat-generation resistors having positive resistance-temperature characteristics and electrically connected in parallel to each other between the first electro-conductive element and the second electro-conductive element, wherein the plurality of heat-generation resistors are configured so that a heat-generation amount per unit length in the lengthwise direction decreases from recording material conveyance reference for determining a position of the recording material in the lengthwise direction towards an end portion in the lengthwise direction, and wherein a first total heat-generation distribution combined the heat-generation distribution of the first heat-generation line with the heat-generation distribution of the second heat-generation line in a first case where the first heat-generation line and the second heat-generation line are controlled based on a first power ratio and the recording material is not fed in the nip portion, a second total heat-generation distribution in a second case where the first heat-generation line and the second heat-generation line are controlled based on a second power ratio and the recording material is not fed in the nip portion, a third total heat-generation distribution in a third case where the first heat-generation line and the second heat-generation line are controlled based on a first power ratio and a small-size recording material is fed in the nip portion, a fourth total heat -generation distribution in a fourth case where the first heat-generation line and the second heat-generation line are controlled based on a second power ratio and the small-size recording material is fed in the nip portion, are all different.

2. The heater according to claim 1, wherein the second heat-generation line is configured so that a heat-generation amount per unit length in the lengthwise direction increases from the recording material conveyance reference towards the end portion in the lengthwise direction.

3. The heater according to claim 2, wherein the second heat-generation line includes a third electro-conductive element provided along the lengthwise direction of the substrate, a fourth electro-conductive element provided along the lengthwise direction at a position different from the third electro-conductive element in the widthwise direction, and a plurality of heat-generation resistors having positive resistance-temperature characteristics and electrically connected in parallel to each other between the third electro-conductive element and the fourth electro-conductive element.

4. The heater according to claim 1, wherein the second heat-generation line includes a heat-generation resistor provided on the substrate along the lengthwise direction of the substrate.

5. The heater according to claim 4, wherein the heater is provided with two first heat-generation lines and the second heat-generation line is provided between these two first heat-generation lines.

6. An image heating device comprising:

an endless belt;

a heater that contacts an inner surface of the endless belt;

a nip portion forming member for forming a nip portion together with the heater via the endless belt, configured to heat while sandwiching and conveying, a recording material on which an image is carried in the nip portion, wherein the heater including:

a substrate having lengthwise and widthwise dimensions;

a first heat-generation line provided on the substrate along a lengthwise direction of the substrate; and a second heat-generation line provided along the lengthwise direction at a position different from the first heat-generation line in a widthwise direction of the substrate and configured to have a heat-generation distribution different from that of the first heat-generation line;

wherein the first heat-generation line and the second heat-generation line are controllable independently, wherein at least the first heat-generation line out of the first heat-generation line and the second heat-generation line includes, a first electro-conductive element provided on the substrate along the lengthwise direction, a second electro-conductive element provided along the lengthwise direction at a position different from the first electro-conductive element in the widthwise direction on the substrate, a plurality of heat-generation resistors having positive resistance-temperature characteristics and electrically connected in parallel to each other between the first electro-conductive element and the second electro-conductive element, wherein the plurality of heat-generation resistors are configured so that a heat-generation amount per unit length in the lengthwise direction decreases from recording material conveyance reference for determining a position of the recording material in the lengthwise direction towards an end portion in the lengthwise direction, and wherein a first total heat-generation distribution combined the heat-generation distribution of the first heat-generation line with the heat-generation distribution of the second heat-generation line in a first case where the first heat-generation line and the second heat-generation line are controlled based on a first power ratio and the recording material is not fed in the nip portion, a second total heat-generation distribution in a second case where the first heat-generation line and the second heat-generation line are controlled based on a second power ratio and the recording material is not fed in the nip portion, a third total heat-generation distribution in a third case where the first heat-generation line and the second heat-generation line are controlled based on a first power ratio and a small-size recording material is fed in the nip portion, a fourth total heat-generation distribution in a fourth case where the first heat-generation line and the second heat-generation line are controlled based on a second power ratio and the small-size recording material is fed in the nip portion, are all different.

7. The image heating device according to claim 6, wherein the second heat-generation line is configured so that a heat-generation amount per unit length in the lengthwise direction increases from the recording material conveyance reference towards the end portion in the lengthwise direction.

8. The image heating device according to claim 7, wherein the second heat-generation line includes a third electro-conductive element provided along the lengthwise direction of the substrate, a fourth electro-conductive element provided along the lengthwise direction at a position different from the third electro-conductive element in the widthwise direction, and a plurality of heat-generation resistors having positive resistance-temperature characteristics and electrically connected in parallel to each other between the third electro-conductive element and the fourth electro-conductive element.

9. The image heating device according to claim 6, wherein the second heat-generation line includes a heat-generation resistor provided on the substrate along the lengthwise direction of the substrate.

10. The image heating device according to claim 9, wherein the heater is provided with two first heat-generation lines and the second heat-generation line is provided between these two first heat-generation lines.

11. A heater for an image heating device that heats a recording material on which an image is carried while sandwiching and conveying the recording material at a nip portion, comprising:

a substrate having lengthwise and widthwise dimensions;

a first heat-generation line provided on the substrate along a lengthwise direction of the substrate; and a second heat-generation line provided along the lengthwise direction at a position different from the first heat-generation line in a widthwise direction of the substrate and configured to have a heat-generation distribution different from that of the first heat-generation line;

wherein the first heat-generation line and the second heat-generation line are controllable independently, wherein the first heat-generation line includes, a first electro-conductive element provided on the substrate along the lengthwise direction, a second electro-conductive element provided along the lengthwise direction at a position different from the first electro-conductive element in the widthwise direction on the substrate, a plurality of heat-generation resistors having positive resistance-temperature characteristics and electrically connected in parallel to each other between the first electro-conductive element and the second electro-conductive element, wherein the plurality of heat-generation resistors are configured so that a heat-generation amount per unit length in the lengthwise direction decreases from recording material conveyance reference for determining a position of the recording material in the lengthwise direction towards an end portion in the lengthwise direction, wherein the second heat-generation line includes, a third electro-conductive element provided on the substrate along the lengthwise direction, a fourth electro-conductive element provided along the lengthwise direction at a position different from the third electro-conductive element in the widthwise direction on the substrate, a plurality of heat-generation resistors having positive resistance-temperature characteristics and electrically connected in parallel to each other between the third electro-conductive element and the fourth electro-conductive element.

12. The heater according to claim 11, wherein the second heat-generation line is configured so that a heat-generation amount per unit length in the lengthwise direction increases from the recording material conveyance reference towards the end portion in the lengthwise direction.

13. An image heating device comprising:

an endless belt;

a heater that contacts an inner surface of the endless belt;

a nip portion forming member for forming a nip portion together with the heater via the endless belt, configured to heat while sandwiching and conveying, a recording material on which an image is carried in the nip portion, wherein the heater including:

a substrate having lengthwise and widthwise dimensions;

a first heat-generation line provided on the substrate along a lengthwise direction of the substrate; and a second heat-generation line provided along the lengthwise direction at a position different from the first heat-generation line in a widthwise direction of the substrate and configured to have a heat-generation distribution different from that of the first heat-generation line;

wherein the first heat-generation line and the second heat-generation line are controllable independently, wherein the first heat-generation line includes, a first electro-conductive element provided on the substrate along the lengthwise direction, a second electro-conductive element provided along the lengthwise direction at a position different from the first electro-conductive element in the widthwise direction on the substrate, a plurality of heat-generation resistors having positive resistance-temperature characteristics and electrically connected in parallel to each other between the first electro-conductive element and the second electro-conductive element, wherein the plurality of heat-generation resistors are configured so that a heat-generation amount per unit length in the lengthwise direction decreases from recording material conveyance reference for determining a position of the recording material in the lengthwise direction towards an end portion in the lengthwise direction, wherein the second heat-generation line includes, a third electro-conductive element provided on the substrate along the lengthwise direction, a fourth electro-conductive element provided along the lengthwise direction at a position different from the third electro-conductive element in the widthwise direction on the substrate, a plurality of heat-generation resistors having positive resistance-temperature characteristics and electrically connected in parallel to each other between the third electro-conductive element and the fourth electro-conductive element.

14. The image heating device according to claim 13, wherein the second heat-generation line is configured so that a heat-generation amount per unit length in the lengthwise direction increases from the recording material conveyance reference towards the end portion in the lengthwise direction.

* * * * *